United States Patent [19]

Beisler

[11] 4,318,356

[45] Mar. 9, 1982

[54] ARRANGEMENT FOR SEWING SEPARATE SUCCESSIVE SEAMS ALONG DIFFERENT DIRECTIONS IN A FABRIC MATERIAL

[75] Inventor: Alfons Beisler, Goldbach, Fed. Rep. of Germany

[73] Assignee: Beisler Gesellschaft mit beschrankter Haftung, Goldbach, Fed. Rep. of Germany

[21] Appl. No.: 190,237

[22] Filed: Sep. 24, 1980

[30] Foreign Application Priority Data

Sep. 27, 1979 [DE] Fed. Rep. of Germany ..... 2939238

[51] Int. Cl.[3] ..... D05B 3/00

[52] U.S. Cl. ..... 112/121.14

[58] Field of Search ..... 112/121.14, 121.11, 112/121.12, 121.15

[56] References Cited

U.S. PATENT DOCUMENTS 2,864,327 12/1958 Cole et al. ..... 112/121.14
3,515,080 6/1970 Ramsey ..... 112/121.14
3,738,292 6/1973 Hintzen et al. ..... 112/121.14 X
3,765,349 10/1973 Gerber ..... 112/121.14
3,812,801 5/1974 Lukowicz ..... 112/121.14

*Primary Examiner*—H. Hampton Hunter
*Attorney, Agent, or Firm*—Freilich, Hornbaker, Wasserman, Rosen & Fernandez

[57] ABSTRACT

The arrangement comprises a sewing apparatus which is partially supported below a material-supporting table and which partially extends through an opening above the table surface. Control means are provided to control the operation of the sewing apparatus as well as to feed the material to be sewn along each direction in which a seam is to be formed. Sensing means are provided to sense the fact that a seam has been completed. Also, means are provided which clamp the material to the table after each seam is sewn. The control means further include means to rotate the sewing apparatus and align it in such a way that when the material is again fed to the sewing apparatus, the latter sews a successive seam along a different selected direction.

1 Claim, 7 Drawing Figures

ARRANGEMENT FOR SEWING SEPARATE SUCCESSIVE SEAMS ALONG DIFFERENT DIRECTIONS IN A FABRIC MATERIAL

BACKGROUND OF THE INVENTION

1. Field of the Invention

The invention concerns a device for the formation of a seam along at least a portion of the edges of a piece of material, particularly for stitching around the edges of an essentially polygonal piece of material, comprising a sewing machine and a table to support the material during the sewing process.

2. Description of the Prior Art

In order to stitch a piece of material around successive edges, a trouser pattern for example, one may have an operator insert the piece into the sewing machine, pass it through the sewing machine along one edge, turn it about the needle tip at the end of the edge, and pass it through the sewing machine along the successive edge, etc. This procedure is relatively time-consuming. Another familiar method is to use two sewing machines with parallel sewing directions, in order to sew two parallel edges of a piece of material. After passing through the first machine, the material is shifted parallel to itself by use of a transporter and introduced into the second sewing machine, which it passes in the opposite direction, for example. This procedure is not only very elaborate in terms of the required machines, but also demands a large installation area. The expenditure increases accordingly, if three or more edges of a piece of material have to be stitched.

SUMMARY OF THE INVENTION

The invention is directed to a reasonably inexpensive apparatus for sewing or stitching a seam along several successive edges of a piece of material, which is operable in a small installation area, with little operating effort, and at high operating speed.

According to the invention, the sewing machine apparatus is mounted so that it can turn about an axis of rotation that is essentially vertical with respect to the table surface and which passes through the point where the sewing machine needle passes through the table surface. A feed device is provided to feed the material essentially parallel with the respective sewing direction and a control device is provided to control the sewing apparatus drive, the feed device, and a rotary drive to turn the sewing apparatus about its rotary axis according to the desired course of the seam.

With the apparatus according to the invention, the initially stated problems are solved in a surprisingly simple manner, since it is much easier to turn the sewing apparatus about a fixed axis than to automatically orient pieces of material which differ in their form and makeup in such a manner that their adjacent edges pass through the sewing apparatus, parallel to the sewing direction. To allow rotation of the sewing apparatus, the latter is preferably mounted on a rotary frame that is mounted beneath the table top and is moveable by means of the rotary drive. In order to obtain a flush table surface nonetheless, it is recommended that the sewing apparatus be mounted in a turntable that is flush with the table surface.

In order to obtain a contiguous seam in the transition from one edge of the piece of material to another edge of the piece of material, the sewing apparatus drive is suitably controlled in such a manner that the needle remains in the material when the sewing apparatus is turned about its axis of rotation. This allows relative rotation between the material and the sewing apparatus, but also prevents a shift of the material with respect to the sewing apparatus.

The control device preferably features a scanning device that reacts to the successive edge of the piece of material in the sewing direction, along which the next seam is to be produced, after rotation of the sewing apparatus, along which the previous seam is to be continued. This type of control has the advantage that it can be used with any shape of material sections, i.e. it is independent of the respective lengths of the edges to be stitched about, or of their enclosed angle.

The control device is preferably so configured that both the disconnection of the sewing apparatus drive and the connection of the rotary drive, as well as the disconnection of the rotary drive and the reconnection of the sewing apparatus drive are controlled by the same edge of the material. This may, for example, be accomplished by having each successive edge pass the scanning device, as the piece of material passes through the sewing apparatus, along a first edge, shortly before the needle reaches the end of the first edge. The sewing apparatus drive is then disconnected in the above manner with a certain delay, so that the needle remains in the material. When the sewing apparatus is then turned about its rotary axis with respect to the material, which remains immobile on the table surface, the scanning device again encounters the second edge of the material and then causes the rotary drive to be disconnected and the sewing apparatus drive to be connected.

Reliable and precise scanning can be obtained, when the scanning device contains at least one optical scanning element that turns together with the sewing apparatus and which reacts to optical differences between the material the the surface of the turntable and/or an active or passive luminescent element attached to it. Such an optical scanning element may be a photoelectric transmitter and receiver arrangement, for example, which acts in conjunction with a reflective foil, mounted on the turntable, with the reflective foil being either exposed or covered by the edge of the material that glides over it, to trigger a signal in the photoelectric transmitter and receiver arrangement.

The scanning device preferably comprises two scanning elements that are spaced successively in the feed direction and ahead of the sewing location, with the scanning element that is further from the sewing location controlling the speed of the sewing apparatus drive, and the scanning element, that is closer to the sewing location, controlling the connection and disconnection of the sewing apparatus drive and of the rotary drive. Prior to stopping the sewing apparatus drive when used with very high speed sewing apparatuses, it is best to reduce the sewing speed first, since it is otherwise practically impossible to stop the sewing apparatus drive in such a way that the sewing needle remains in the material. In order to enable feeding and removing the pieces of material at the same points at all times, the apparatus is designed so that it can assume at lease one intermediate position, defined by the position of that edge of the piece of material on the table along which the next seam is to be formed, between a defined starting position and a defined end position. The defined starting position and end position make it possible to connect automatic feed and clearing machines, for example. In the case of trouser parts, that are to be stitched along three sides, for example, one may provide that the starting position and the end position of the sewing apparatus are 180°, opposite to one another and correspond to the essentially parallel longitudinal edges of the trouser pattern, while the intermediate position is determined by the scanning device.

A clamping device may be provided to hold the material on the table top during the rotation of the sewing apparatus. The piece of material is then held by the sewing needle, but this is not sufficient, especially in the case of heavy and long pieces that hang over the table top. Such a clamping device may simply be configured as a plunger that can be radially lowered onto the table surface outside of the turntable, to hold the material on the immobile part of the table top during the rotation of the sewing apparatus and the turntable.

In order to assure perfect transport of the material on the table top, without distortion and bunching, the feed device may comprise a driven feed roll that is connected with the sewing apparatus and that can be adjusted up and down with respect to the table top, by being supported at a lateral distance from the sewing location, by a shaft that is parallel with the table surface and at right angles to the feed direction, in addition to the sewing apparatus transport. During the sewing process the feed roll is lowered onto the material and assures that the material is not only advanced along the edge that is passing through the sewing apparatus. In order to assure synchronous transport of the material by the sewing apparatus and the feed roll, the latter may be suitably connected with the sewing apparatus drive, via an infinitely variable gearing. The adjustment of the feed roll relative to the table surface may be controlled, as function of the rotary movement of the sewing apparatus, such that the feed roll is lifted from the table surface during the rotary movement of the sewing apparatus.

In order to obtain penetration of the sewing apparatus needle at a defined distance from the respective distance from the respective fabric edge, the feed device may comprise a guide bar, placed ahead of the sewing location in the transport direction, and be essentially parallel with the feed direction, as well as at least one guide roll that is mounted to rotate on a nearly horizontal shaft at a lateral distance from the guide bar ahead of the sewing location, obliquely to the feed direction. Thus, the guide roll, rolling on the material, guides the material against the guide bar. A further guide roll is preferably mounted ahead of the first guide roll in the feed direction, to work together with a driven counter roll, that is mounted in the table top, tangentially with the table surface, and to actively guide the piece of material against the guide bar.

In order to prevent the material from bunching up behind the sewing location, the table is preferably configured such that the table edges that run obliquely to the sewing direction of the sewing apparatus in its starting or end position, come together in the direction away from the sewing apparatus. When the sewing apparatus is in its starting or end position, this edge configuration creates tension in the material, hanging over the table edges, which pulls the material away from the sewing apparatus, out of the sewing location.

Since the position of the piece of material after the sewing process is not defined in the intermediate position of the sewing apparatus, an orienting device is expediently provided, to orient the piece of material relative to the sewing apparatus in its end position. This orienting device may be configured as a swivel arm that is mounted to turn about an essentially vertical axis. at a slight distance below the table top and which can be turned from a first position, in which it is aligned parallel with a table edge that is oblique to the sewing direction, outside the table top, to a second position, in which it essentially lies beneath the table top. During its transition into the first position, the swivel arm meets the piece of material, hanging over the edge of the table, and aligns it, so that it enters correctly into the sewing apparatus in its end position.

The novel features of the invention are set forth with particularity in the appended claims. The invention will best be understood from the following description when read in conjunction with the accompanying drawings.

DETAILED DESCRIPTION OF THE PREFERRED EMBODIMENTS

FIGS. 1 to 7 illustrate a system to stitch or sew seams about the edges of a fabric pattern. Although the invention will be described in connection with stitching around three edges of a trouser pattern, it is clearly not intended to be limited thereto.

Figure 1:
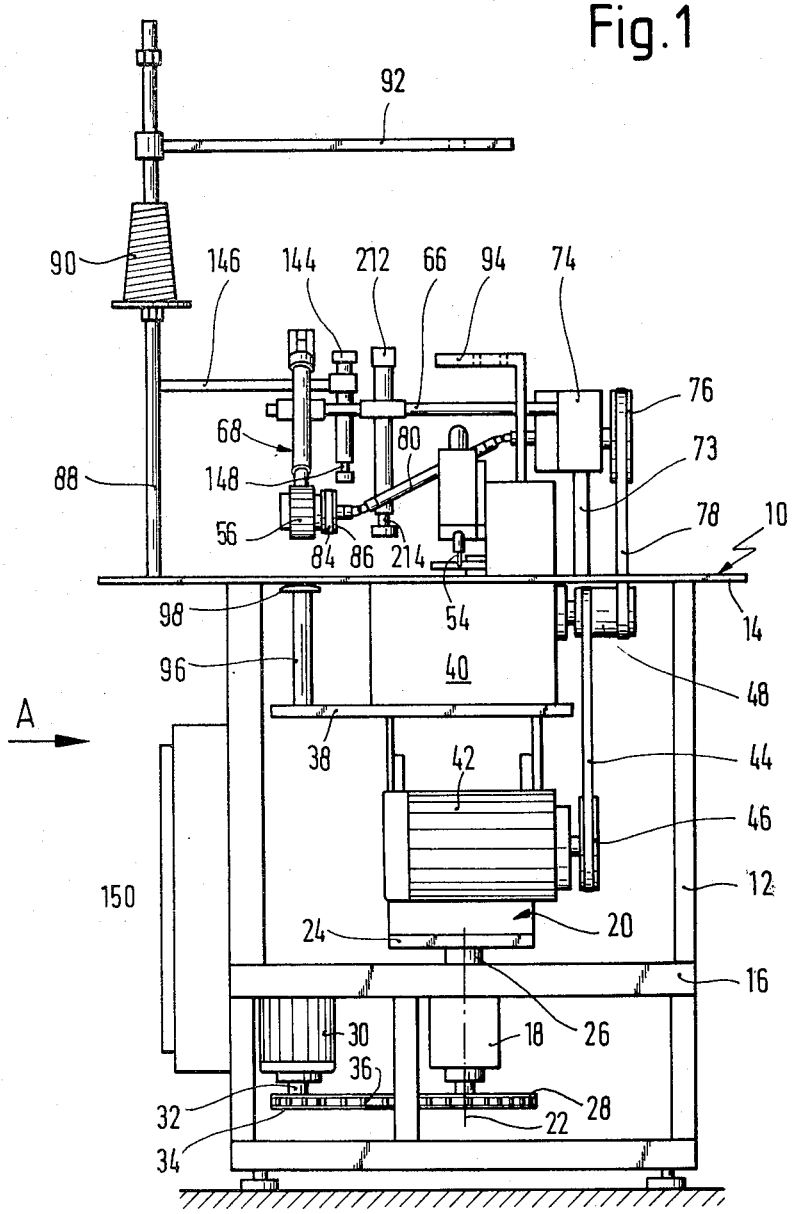
FIG. 1 is a partial schematic frontal view of the system in accordance with the present invention.
Figure 2:
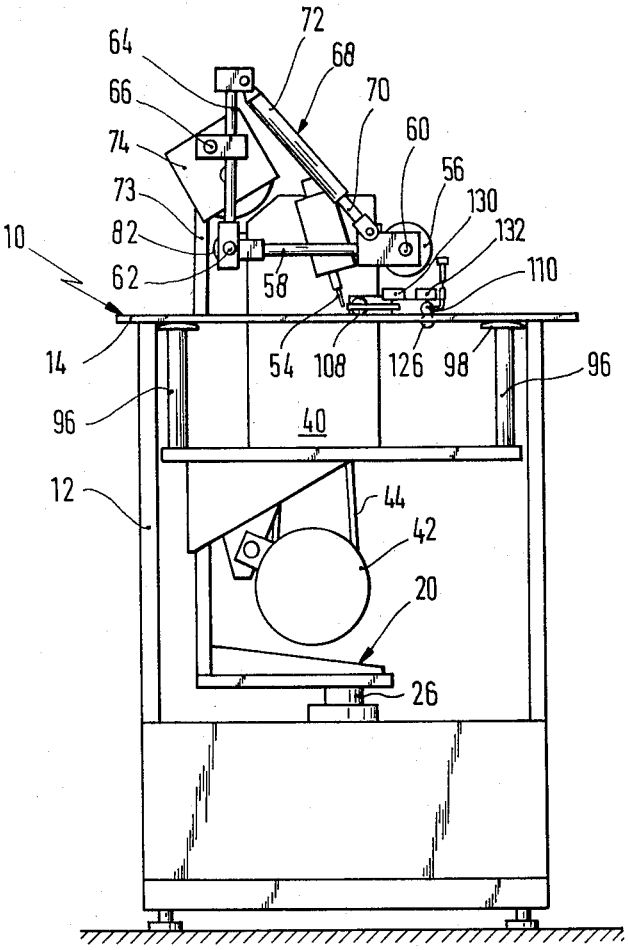
FIG. 2 is a lateral view of the system shown in FIG. 1, from the direction of the arrow A in FIG. 1, with some of the parts, shown in FIG. 1, having been left out for the sake of clarity.

In FIGS. 1 and 2, numeral 10 represents a table with a frame 12 and a table top 14. A rotary frame 20 is mounted to turn about a vertical axis 22 in a bearing 18, attached to a brace 16 of the frame 12. The rotary frame 20 is essentially U-shaped and rests with one leg 24 of the U on a shaft 26, which passes through the bearing 18. A chain sprocket 28 is firmly attached to the lower end of the shaft 26 and is driven by an electric motor 30 via a pinion gear 34 on its output shaft and a drive chain 36 which connects the pinion gear 34 with the chain sprocket 28. By use of the electric motor 30, the rotary frame 20 can thus be turned about the axis 22.

A sewing apparatus 40 is mounted on the upper leg 38 of the U of the rotary frame 20. Since the invention is being described in connection with a conventional single needle sewing apparatus, the sewing apparatus 40 is being shown in block form, without detailed description. The sewing apparatus 40 is driven by an electric motor 42, which is mounted on the rotary frame 20, via a drive belt 44, which connects a pulley 46 on the output shaft of the electric motor 42 with a roller 48 on the input shaft of the sewing apparatus 40.

The sewing apparatus 40 passes through the table top 14 in such a manner that the stitch plate of the sewing apparatus 40, which is not labeled, is flush with the table surface. The part of the table top that surrounds the sewing apparatus 40 is configured as turntable 50 (see FIGS. 3 to 5), separated from the rest of the table top 14 by a circular gap or opening 52.

The sewing apparatus 40 is mounted on the rotary frame 20 in such a manner that the axis 22 passes through the point where the needle 54 of the sewing apparatus 40 passes into the surface of the table. This means that the sewing apparatus 40 essentially turns about the tip of the needle when the rotary frame turns.

For transport of the material, during the sewing process, a feed roll 56 is provided, apart from the usual transport device, built into the sewing apparatus 40, which is supported by a horizontal shaft 60 (See FIG. 2) at right angles to the sewing direction, attached to an articulated arm 58. The articulated arm 58 is articulated about a shaft 62 that is parallel to the shaft 60. Shaft 62 is mounted on a vertical rod 64, which, in turn, is mounted to a support 66, that runs at right angles to the sewing direction and is in turn rigidly connected with the sewing apparatus 40. The articulated arm 58 can be adjusted with a pneumatic piston-cylinder arrangement 68, whose piston rod 70 attaches to the end of the articulated arm 58 that is closer to the feed roll 56, and whose cylinder 72 is supported against the upper end of the rod 64. By use of the piston-cylinder arrangement 68 the feed roll 56 can be moved between a raised position, shown in FIGS. 1 and 2, and the lowered position in which it rests on the material that lies on the table top 14.

The feed roll 56 is driven synchronously with the sewing speed by the sewing apparatus 40. The drive mechanism for the feed roll 56 comprises an infinitely variable gearing 74, mounted on a support 73, whose input shaft is driven via a pulley 76 which is attached to it and a drive belt 78 driven by the roll 48 of the sewing apparatus drive. The drive shaft of the gearing 74 drives a roller 82 that is mounted to turn on the lower end of the rod 64, coaxially with the shaft 62, via a universal shaft. Via a belt 84, the roller 82 drives a roller 86 that is mounted coaxially with the feed roll 56 and is rigidly connected with it.

In FIG. 1 a frame 88 is shown. It is mounted on the table top 14 to support one or more sewing thread bobbins 90, from which the sewing thread is passed to the sewing apparatus via a first thread guide 92 and a second thread guide 94. When routing the thread, particularly several threads, one must take care that the threads do not twist about some part or about one another when the sewing apparatus 40 is turned 180°, resulting in interference. Apart from that, thread delivery may be accomplished in the conventional manner.

Since the stability of the table top 14 is reduced by the cutting out of the turntable 50 in its center area, supports 96 are mounted on the upper U leg 38 of the rotary frame 20 in an area between the vertical posts of the frame 12, in order to support the table top. They contact the bottom of the table top 14 via gliding heads 98 and support it in an area close to the opening 52.

In order to assure correct entry of the material 100 (See FIG. 3) into the proper sewing location of the sewing apparatus 40, a feed-in element 102 is mounted ahead of the sewing location in the feed direction. It comprises a guide bar 104 that is curved about a vertical axis and guides the edge of the entering material, and a cover plate 106 (See FIG. 7) that is parallel with the table top 14. Plate 106 is mounted at a distance from the table top 14 that roughly corresponds to the fabric thickness, in order to smooth the entering fabric.

A guide roll 108 is supported in a slot of the cover plate 106, so that it turns freely and that the center plane that stands perpendicularly on its shaft points toward the sewing needle, forming an actue angle with the sewing direction. The guide roll 108 is turned by the entering fabric and causes the fabric to be moved against the guide bar 104.

The guide roll 108, with the cover plate 106, is height adjustable in a manner not illustrated, so that it can be raised prior to the rotation of the sewing apparatus 40.

Figure 6:
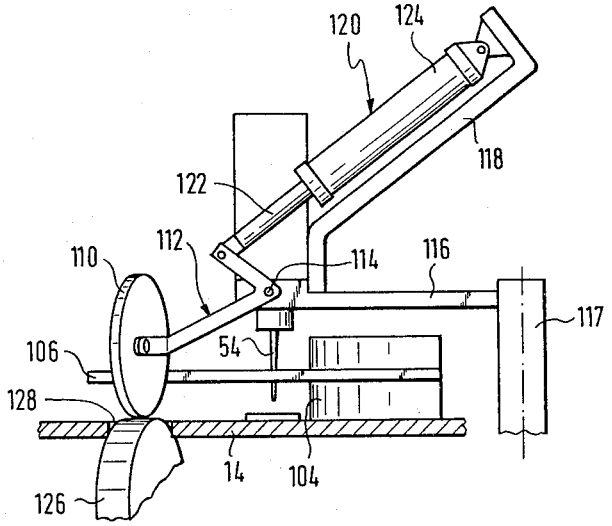
FIG. 6 is a view of the scanning device and the adjustable guide roll by themselves, in the direction of the arrow B in FIG. 3.

Apart from the guide roll 108 another guide roll 110 (See FIG. 2) is provided, which is essentially free to rotate in parallel with the guide roll 108 and is supported on one arm of the elbow lever 112 (See FIG. 6). The elbow lever 112 is in turn articulated about a shaft 114 that is parallel to the sewing direction and mounted on a carrier 116. A support 118 is connected with the carrier 116 which serves to mount a pneumatic piston-cylinder arrangement 120. The piston rod 122 attaches to the other arm of the elbow lever 112, while the cylinder 125 of the piston-cylinder arrangement 120 is supported against the support 118.

The in-and-out movement of the piston rod 122 adjusts the elbow lever 112, so that the guide roll 110 can be lowered onto the table top 14, or lifted from the latter. In its lowered position, the guide roll acts together with the drive roll 126, which is mounted beneath the table top, and is connected with a drive that is not illustrated. It emerges slightly through a slot 128 in the table top 14 with its peripheral surface. Thus, the guide roll 110 and the drive roll 126 cause the entering material to be guided against the guide bar 104 with its edge.

The carrier 116 also holds two photoelectric transmitter and receiver arrangements 130 and 132 (See FIG. 3) which are arranged successively in the feed direction, and function together with reflective strips 134 and 136 respectively. The strips are fastened to the turntable, so that they produce a signal when the respective reflective strip is exposed or covered by a piece of fabric. The function of the photoelectric transmitter and receiver arrangements 130, 132 will be discussed in greater detail below. The transmitter and receiver arrangements 130 and 132 may contain a light source each, for example, whose light is reflected by the respective reflective strips and received by a photo cell or other photoelectric converter for processing.

Figure 3:
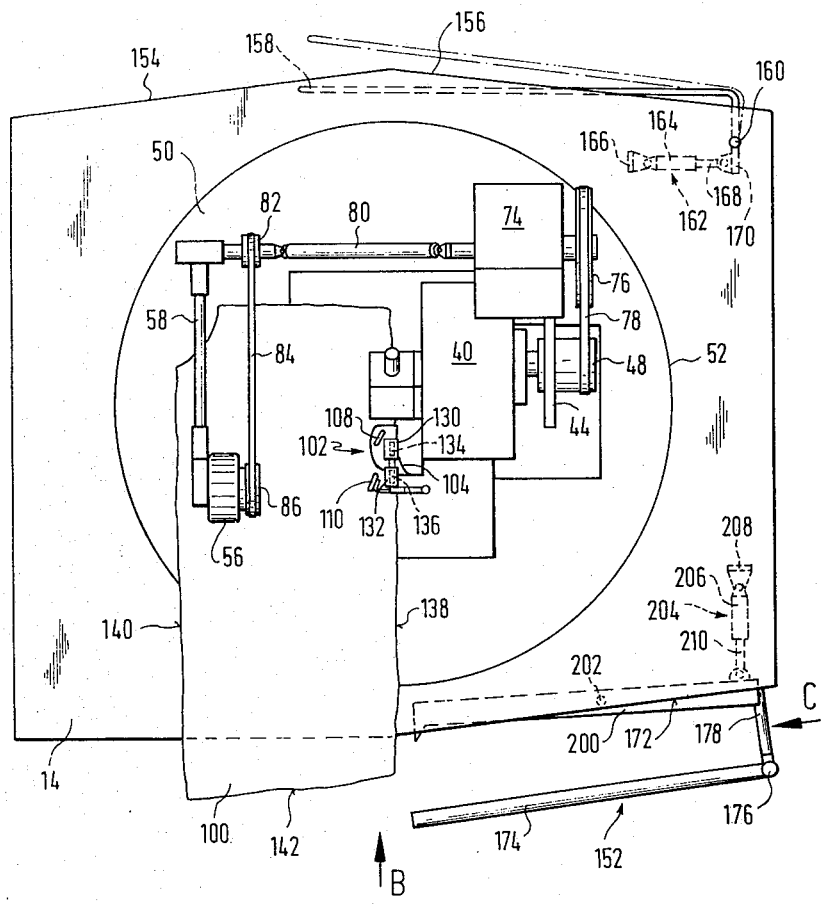
FIG. 3 is a simplified plan of the system, shown in FIG. 1, with the sewing machine in the starting position.

The carrier 116 (See FIG. 6) is mounted to a vertical support 118, which can be rotated about its longitudinal axis, so that the guide roll 110, together with its adjustment device, and the photoelectric transmitter and receiver arrangements 130 and 132 can be turned counterclockwise from their lowered position, shown in FIG. 3, so that one gains free access to the feed-in part 102.

The function of the device according to the invention will be explained in greater detail below, with particular reference to FIGS. 3 to 5.

FIG. 3 shows the sewing apparatus 40 in its defined starting position. In this position the piece of fabric material 100 e.g. trouser pattern which is to be stitched round its two longitudinal edges 138 and 140, as well as one lateral edge 142, is placed against the guide bar 104 with its edge 138 and introduced into the sewing location. Then the sewing apparatus drive is connected, which simultaneously lowers the feed roll 56 onto the fabric 100. The fabric 100 then passes through the sewing apparatus, while the edge 138 is stitched. The passage of the fabric material can be further facilitated by providing air jets in the turntable, (which are not illustrated) and through which compressed air is blown, so that the fabric material travels on an air cushion.

The fabric material 100 moves until the edge 142 passes over the reflective strip, associated with the photoelectric transmitter and receiver arrangement 132. When the photo cell of this transmitter and receiver arrangement received light, the sewing apparatus drive is set to a slow speed. Shortly thereafter, the edge 142 passes over the reflective strip 130, which is associated with the transmitter and receiver arrangement 130, and which lies closer to the needle 54. A signal from this transmitter and receiver arrangement 130 causes the sewing apparatus drive to be disconnected after a delay and the feed roll 56 is raised. The delay is so timed that the fabric material 100 is stopped at a slight distance of the needle 54 from the edge 142, with the needle 54 remaining in the fabric 100.

At the same time the fabric material 100 is clamped to the table top 14 by a plunger 144 (See FIG. 1). The plunger 144 is connected to a carrier 146, that is firmly connected with the support frame 88 and is configured as a pneumatic piston-cylinder arrangement. The outward movement of the piston rod 148 causes the fabric material 100 to be clamped between the free end of the piston rod 148 and the table top 14, so that it cannot slip from the table top during the following rotation of the sewing apparatus 40. As a function of a signal produced by the transmitter-receiver arrangement, the rotation of the sewing apparatus 40 about the axis 22 is controlled, as are the other switching processes, by a control device which is housed in the control box 150, shown in FIG. 1.

The sewing apparatus 40 is rotated clockwise (with reference to the illustrations in FIGS. 3 to 5), until the edge 142 of the unmoved fabric material 100 covers the reflective strip 134 and thus again causes a signal to be produced in the photoelectric transmitter and receiver arrangement 130. The sewing apparatus 40 is in the intermediate position illustrated in FIG. 4. In this position the rotational drive for the rotary frame 20 is disconnected, following the produced signal, the feed roll 56 is lowered onto the table top 14, and the sewing apparatus drive is again connected. The fabric material 100 is transported through the sewing apparatus in the direction of its edge 142, until the edge 140 of the fabric 100 glides over the reflective strip 136 and then the reflective strip 134, again triggering the above described control processes. In the special version described here, the sewing apparatus 40 is then rotated into its end position, illustrated in FIG. 5, in which it is turned exactly 180° with respect to its starting position. This end position is therefore independent of the course of the edges of the piece of fabric. It is of course possible to provide other intermediate positions for differently formed pieces of fabric, determined by the course of the edges of the fabric alone.

When the end position is reached, the feed roll 56 is again lowered onto the table top 14 and the sewing apparatus drive is connected, whereupon the fabric material 100 passes through the sewing apparatus with its edge 140. When the end of edge 140 is reached, which is again determined by the photoelectric transmitter and receiver arrangement or scanning elements, the thread is bartacked onto the fabric and cut. Then the fabric material 100 is stacked by a stacking unit that is generally designated as 152 and which will be described in greater detail in connection with FIG. 7 below.

Figure 4:
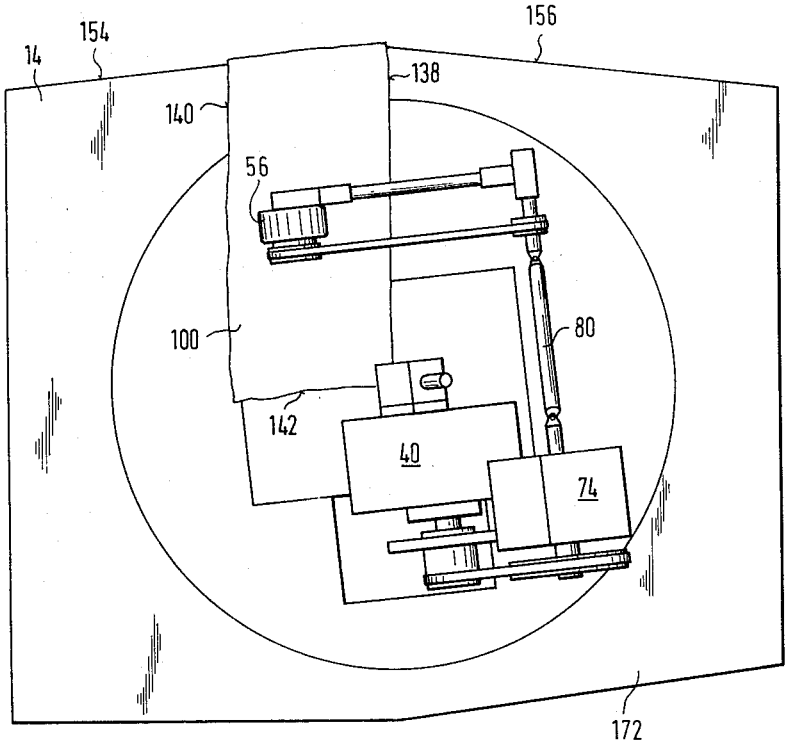
FIG. 4 is an illustration corresponding to FIG. 3, with the sewing apparatus in an intermediate position.
Figure 5:
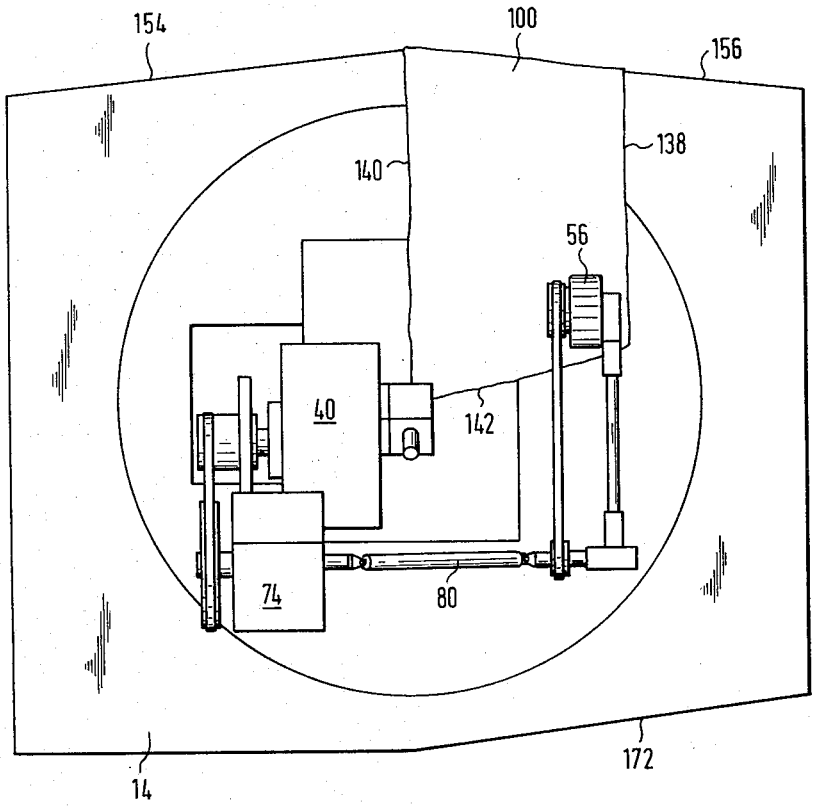
FIG. 5 is an illustration corresponding to FIGS. 3 and 4, with the sewing apparatus in its end position.

As can be seen from FIGS. 3 to 5, the table edges, that essentially run obliquely with respect to the sewing direction of the sewing apparatus in its starting and end positions, are slanted to come together in a direction away from the sewing apparatus. The reason for this is that a tension away from the sewing location is to be produced on the fabric passing through the sewing apparatus. When the piece of fabric 100 passes through the sewing apparatus in its position, as illustrated in FIG. 3, for example, it drops over the table edge labeled 154 on the table top 14. The slant of this table edge 154 exerts a tension to the left, as seen in FIG. 3, on the piece of fabric 100, which pulls it away from the sewing location. This prevents the fabric from accumulating behind the sewing location and possibly bunching up.

Depending on the course of the edge 142, the piece of fabric 100 is moved over the table top 14 in different directions, after stitching about of the first edge 138. It may happen that the piece of fabric 100 may remain hanging over the table edge 154 after the second edge has been stitched round. This is an unfavorable starting position for stitching up the third edge 140, since the sewing apparatus is in its end position, in which it is turned 180° from its starting position, regardless of the respective edge course. Hence the fabric pattern 100 is expediently aligned so that it now hangs over the table edge section, designated by 156 in FIG. 3. This alignment is accomplished with a swivel arm 158, which is arranged to turn about a vertical shaft 160 on the underside of the table top 14. The swivel arm 158 can be moved from a first position, drawn in solid, resp. broken lines in FIG. 3, and a second position, drawn in dot-dashed lines, in which the swivel arm is essentially parallel with the table edge 156, by use of a pneumatic piston-cylinder arrangement 162, which attaches to a table-mounted holder 166 with its cylinder 164 and to a short lever end 170 of the swivel arm 158 with its piston rod 168. This pulls the fabric pattern 100 away from the table edge 175 to the table edge 156 and orients it in the desired manner.

The stacking mechanism 152 comprises a horizontal carrying rod 174 that is essentially parallel with the table edge and which is labeled by 172 in FIG. 3, and is fastened to a stand 176. At the lower end of the stand 176, an articulated yoke 178 is shown. It is mounted on a swiveling shaft, that is parallel to the carrying rod 172, having a leg 180 that lies in a vertical plane with the stand 176 and is articulated with it, and a leg 182 that is parallel with the carrying rod 147. The length of the leg 180 is so dimensioned that the leg 182 essentially comes to lie immediately next to the carrying rod 174 when the yoke 178 is swiveled against the stand 176.

The yoke 178 is spring loaded in the direction of the stand 176 by a spring 184, which attaches to the stand 176 on one end and to a lever 186 that is firmly attached to the yoke 178 on the other end. Also articulated to the stand 176 by a shaft that is parallel to the swiveling shaft of the yoke 178 is a double arm lever, whose one lever arm 188 rests against the leg 180 of the yoke 178 via a roller 190 attached to its free end, and the free end of its other lever arm 192 is connected with the free end of a piston rod 194 of a pneumatic piston-cylinder arrangement 196, whose cylinder 198 is against the stand 176. When the piston rod 194 is moved out, the double arm lever is moved counterclockwise in FIG. 7, which makes it possible to swivel the yoke 178 against the carrying rod 174 or the stand 176 under the tension of the spring 184.

Figure 7:
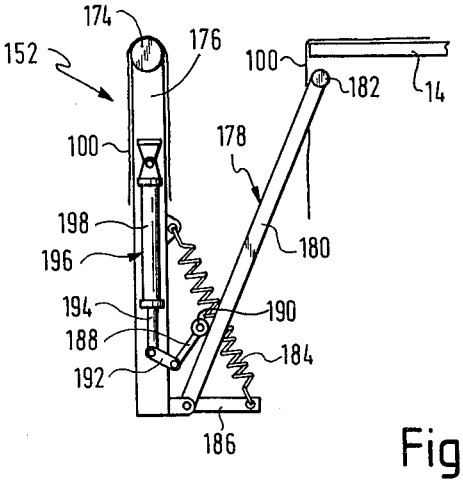
FIG. 7 is a lateral view of the stacking device in the direction of the arrow C in FIG. 3.

As should be realized from FIG. 7, the leg 182 of the yoke 178 is beneath the table top 14 when the stacking unit 152 is in its rest position, so that a piece of fabric hanging over the table top 14 falls between the carrying rod 174 and the leg 182 of the yoke 178. If the yoke 178 is then moved toward the carrying rod 174, it pulls the piece of fabric from the table top 14 and flips it over the carrying rod 174 because of its rapid movement, so that it hangs over the carrying rod 174, in the position illustrated in FIG. 7.

In order to make it possible to stack many pieces of fabric precisely, one above the other, a flat double arm lever 200 (See FIG. 3) is articulated about a vertical swiveling shaft 202 on the underside of the table top 14, near the table edge 172, which can be moved between the positions drawn in solid and broken lines respectively, in FIG. 3, by use of a pneumatic piston-cylinder arrangement 204. The piston-cylinder arrangement 204 is supported against a table mounted holder 208 with its cylinder 206 and against the lever 200 with its piston rod 210. The movement of the lever 200 orients the piece of fabric so that it hangs over an edge that is parallel with the carrying rod 174 resp. the yoke leg 182. Note that the piece of fabric is clampd onto the turntable 50 by a plunger after leaving the sewing location and during alignment, until stacking takes place. The plunger is formed by a pneumatic piston-cylinder arrangement 212 that is mounted on the carrier 66. Its piston rod 214 clamps the piece of fabric against the turntable 50 with its free end in its extended position.

The above described device makes it possible, for example, to stitch a trouser pattern about on three edges and to deposit it on a stack, after placing it on the table, using a single process on a single sewing apparatus, without further intervention of the operator. After the return of the sewing apparatus into its starting position, the operator need only place a new pattern piece onto the table and guide it to the sewing location. It should be apparent that with the present devices several edges of other than a trouser pattern may be stitched and handled as herebefore described.

Although particular embodiments of the invention have been described and illustrated herein, it is recognized that modifications and variations may occur to those skilled in the art, and consequently, it is intended that the claims be interpreted to cover such modifications and equivalents.

I claim:

1. An arrangement for sewing a seam along each of n separate directions in a piece of material, n being an integer not less than two, the arrangement comprising:

sewing means;

material support means for supporting a material in which seams are to be sewn thereon; and control means including means for selectively driving said sewing means to sew each of said seams in said material, feed means for feeding said material to said sewing means, material sense means for sensing the position of said material with respect to said sewing means and means responsive to a signal from said sense means indicating that a seam has been sewn for stopping the driving of said sewing means and for rotating said sewing means so as to align the latter to be in a position with respect to said material to sew a subsequent seam therein.

* * * * *